United States Patent [19]

Morishita et al.

[11] Patent Number: 4,680,979

[45] Date of Patent: Jul. 21, 1987

[54] PLANETARY GEAR STARTER

[75] Inventors: Akira Morishita; Yoshifumi Akae; Kyoichi Okamoto; Taiichi Nakagawa; Hiroyuki Morikane, all of Himeji; Tadami Kounou, Kanzaki; Takemi Arima; Akinori Hasegawa, both of Himeji, all of Japan

[73] Assignee: Mitsubishi Denki Kabushiki Kaisha, Tokyo, Japan

[21] Appl. No.: 810,097

[22] Filed: Dec. 18, 1985

[30] Foreign Application Priority Data

Dec. 20, 1984 [JP] Japan ..... 59-194581[U]
Dec. 20, 1984 [JP] Japan ..... 59-194582[U]

[51] Int. Cl.[4] ..... F02N 15/06

[52] U.S. Cl. ..... 74/7 E; 74/411; 74/801; 310/83

[58] Field of Search ..... 74/7 E, DIG. 10, 411, 74/801, 785, 7 A, 7 R, 6; 310/83; 290/38 C, 48

[56] References Cited

U.S. PATENT DOCUMENTS 4,494,414 1/1985 Hamano ..... 74/411
4,503,719 3/1985 Hamano ..... 74/7 E
4,507,978 4/1985 Tanaka et al. ..... 74/7 E
4,528,470 7/1985 Young et al. ..... 74/801
4,561,316 12/1985 Bolz et al. ..... 74/7 E
4,587,861 5/1986 Morishita ..... 74/801
4,590,811 5/1986 Kasubuchi ..... 74/7 E

*Primary Examiner*—Cornelius J. Husar
*Assistant Examiner*—Peter M. Cuomo
*Attorney, Agent, or Firm*—Leydig, Voit & Mayer

[57] ABSTRACT

A planetary gear starter with a molded synthetic resin ring gear supported by a frame is disclosed. The ring gear has longitudinally-extending ribs formed in its outer surface which confront longitudinally-extending inward projections formed in the inner surface of the frame. A cylindrical elastic member has an annular portion which is press fit over the ring gear and longitudinally-extending projections which fit into the cavities formed between adjacent ribs and inward projections in the frame. The projections of the elastic member serve as shock absorbers and elastically transmit torque from the ring gear to the frame. The elastic member has an annular portion which reinforces the open end of the ring gear.

7 Claims, 8 Drawing Figures

PLANETARY GEAR STARTER

BACKGROUND OF THE INVENTION

This invention relates to a starter having a planetary-type reduction gear housed therein, and more particularly to an improved starter in which an internally-toothed ring gear of the starter is made of a molded synthetic resin.

A conventional starter of this type is disclosed in Japanese Laid-Open Patent Application No. 58-120874, the structure of which is illustrated in FIG. 1 of the accompanying drawings. As shown therein, a starter 1 houses a planetary gear reduction mechanism 2 which has a sun gear 3 which is mounted on an output shaft connected to the rotor of an unillustrated direct current starter motor and a plurality of planet gears 4 which engage with the sun gear 3. The planet gears 4 are surrounded by and engage with an internally-toothed ring gear 5 which is press fit into a front bracket 6. The ring gear 5 is prevented from rotating by the engagement between radially outward projections 5*a* formed in the outer periphery of the ring gear 5 recesses 6*a* formed in the inner peripheral surface of the front bracket 6. The direct current starter motor and the ring gear 5 are secured to the front bracket 6 by unillustrated bolts which pass through holes 7 formed in the outer periphery of the ring gear 5.

The operation of this conventional apparatus will now be explained. When the unillustrated direct current starter motor is energized, the sun gear 3 is caused to rotate together with the rotor of the motor, and the planet gears 4 are caused to perform planetary motion about the sun gear 3. The speed of rotation of the planet gears 4 is less than that of the sun gear 3, and an unillustrated engine is started by the rotation of the planet gears 4. A reaction force which is applied to the ring gear 5 by the rotation of the planet gears 4 is transmitted to the front frame 6 by the engaging members, i.e., the projections 5*a* in the ring gear 5 and the recesses formed in the ring gear 6.

In this type of conventional apparatus, as the ring gear 5 directly engages the front bracket 6, high stresses develop in the ring gear 5 during starting, particularly when the engine dies during cranking and the inertia of the rotor of the starter motor produces a sudden increases in the torque applied to the ring gear 5. When the ring gear 5 is molded from a high polymer synthetic resin such as an engineering plastic, it can be damaged by the high stresses, and breakage can occur. In order to alleviate such problems, elastic buffering means are sometimes provided between the ring gear 5 and the front frame 6. However, the buffering means which are known in the art are complicated and do not adequately prevent deformation of the open end of the ring gear 5.

Furthermore, in a conventional apparatus such as the one illustrated in FIG. 1, when the ring gear 5 is molded, the provision of the projections 5*a* and holes 7 in the ring gear 5 can result in sink marks which produce deformation of the ring gear 5. This deformation causes the stresses arising in the ring gear 5 during use to be nonuniform, and locally high stresses can result in damage to the ring gear.

SUMMARY OF THE INVENTION

It is an object of the present invention to provide a starter having a planetary gear reduction mechanism housed therein in which a molded synthetic resin ring gear of the planetary gear reduction mechanism is elastically supported such that stresses which develop in the ring gear when a sudden increase in load is applied thereto can be decreased.

It is another object of the present invention to provide a starter in which the ring gear is reinforced at its open end so as to prevent deformation of the ring gear during operation.

It is a further object of the present invention to provide a starter in which the means for elastically supporting the ring gear is simple in structure and easily manufactured.

It is yet another object of the present invention to provide a starter in which the ring gear is less subject to deformation due to sink marks which develop during molding of the ring gear.

In a starter according to the present invention, a ring gear of a planetary gear reduction mechanism has longitudinally-extending ribs formed in its outer surface which confront longitudinally-extending inward projections formed in a front frame which supports the ring gear. Longitudinally-extending cavities are formed between the outer surface of the ring gear and the inner surface of the front frame between adjacent ribs and inward projections. A cylindrical elastic member having an annular portion and longitudinally-extending projections is disposed between the ring gear and the front frame, with the annular portion press fit over the open end of the ring gear, and with the projections disposed in the longitudinally-extending cavities. The annular portion of the elastic member serves to reinforce the open end of the ring gear so as to prevent its deformation, and the longitudinally-extending projections act as shock absorbers to elastically transmit loads from the ring gear to the front frame.

The width of the ribs in the circumferential direction of the ring gear is made less than the thickness of the ring gear, thereby reducing the deformation of the ring gear due to sink marks which develop during molding of the ring gear.

BRIEF DESCRIPTION OF THE DRAWINGS

In the figures, the same reference numerals indicate the same or corresponding parts.

DESCRIPTION OF THE PREFERRED EMBODIMENTS

Figure 2:
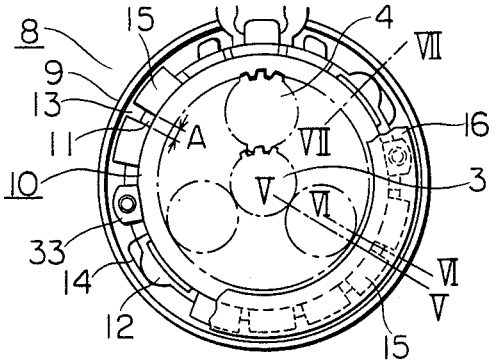
FIG. 2 is an end view of a first embodiment of a starter according to the present invention.

Hereinbelow, a number of preferred embodiments of the present invention will be described while referring to FIGS. 2 through 8 of the accompanying drawings, of which FIGS. 2 through 7 illustrate a first embodiment. As shown in FIG. 2, a starter 8 has housed therein a planetary gear reduction mechanism comprising a sun gear 3, a plurality of planet gears 4, and a ring gear 10 which is concentrically disposed with respect to the sun gear 3 and which meshes internally with the planet gears 4. In the present embodiment, the ring gear 10 is molded from a high polymer synthetic resin, such as Nylon 6G, which is a nylon resin containing a large quantity of glass filler. However, there are no particular limitations on the material of which the ring gear 10 is formed.

Figure 3:
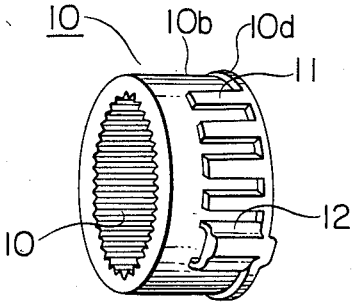
FIG. 3 is a perspective view of the ring gear of the embodiment illustrated in FIG. 2.
Figure 5:
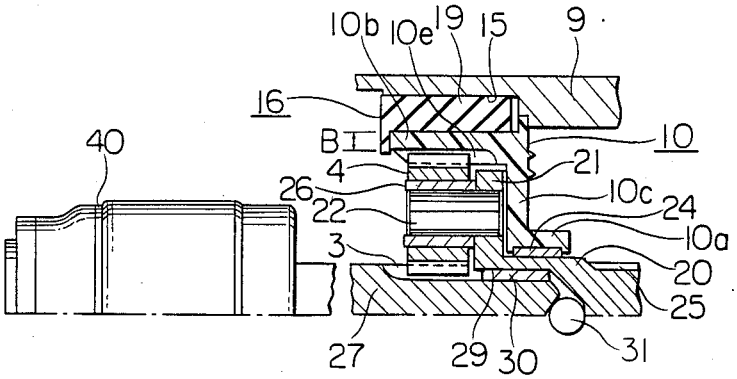
FIGS. 5, 6, and 7 are cross-sectional views taken along Lines V—V, VI—VI, and VII—VII, respectively of FIG. 2.
Figure 7:
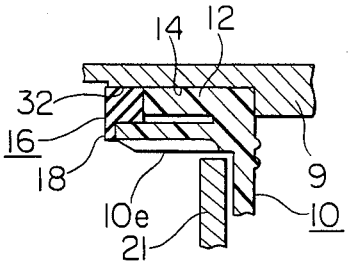

As shown in FIGS. 3 and 5, the ring gear 10 has a first cylindrical portion 10*a*, a second cylindrical portion 10*b* having a larger diameter than the first cylindrical portion 10*a*, and an annular wall 10*c* which extends between the two. The end of the ring gear 10 opposite the annular wall 10*c* is open. The outer diameter of the wall 10*c* is larger than the diameter of the second cylindrical portion 10*b* so that a rim 10*d* is formed on its outer periphery. On the inner periphery of the second cylindrical portion 10*b*, the ring gear 10 has integrally-formed internal teeth 10*e*, while on the outer surface of the second cylindrical portion 10*b* it has a plurality of longitudinally-extending ribs 11 and projections 12, also integrally formed therewith. The outer peripheral surface of each of the ribs 11 is flush with the outer surface of the rim 10*d*. Furthermore, as shown in FIG. 7, which is a cross-sectional view taken along Line VII—VII of FIG. 2, each of the projections 12 has a longitudinally-extending cavity 33 formed therein which acts to prevent deformation of the toothed portion of the ring gear 10 due to sink marks arising during molding.

The width A of each of the ribs 11 in the circumferential direction (see FIG. 2) is chosen to be less than the thickness B of the second cylindrical portion 10*b* of the ring gear 10 measured from its outer peripheral surface to approximately the root circle of the internal teeth 10*e* (see FIG. 5). Choosing the dimensions in this manner contributes to the prevention of deformation of the ring gear 10 due to sink marks produced during molding.

The ring gear 10 is secured to a cylindrical front frame 9 which is preferably made of a diecast aluminum alloy. The front frame 9 has a plurality of longitudinally-extending inward projections 13 and recesses 14 which are formed in its inner peripheral surface and which are positioned so as to confront the ribs 11 and the projections 12, respectively, when the ring gear 10 is inserted into the front frame 9. In this condition, the outer peripheral surfaces of the ribs 11 contact the inner peripheral surfaces of the corresponding projections 13, and longitudinally-extending cavities 15 having a generally rectangular cross section are formed between the adjacent ribs 11 and projections 13 along the outer periphery of the ring gear 10. The front frame is secured to an unillustrated yoke of a direct current starter motor 40 by unillustrated bolts which pass through bolt holes 33 formed in the front frame.

Figure 4:
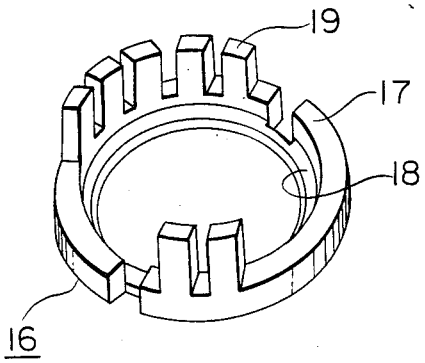
FIG. 4 is a perspective view of the elastic member of the embodiment illustrated in FIG. 2.

An elastic member 16 made of rubber is provided between the outer periphery of the internally-toothed gear 10 and the inner periphery of the front frame 9. As shown in FIG. 4, the elastic member 16 has an annular base 17 around the inside surface of which is formed an annular ledge 18 having a smaller inner diameter than the base 17. Furthermore, a plurality of longitudinally-extending projections 19 are formed on the top surface of the base 17. Each of these projections 19 has a generally rectangular transverse cross-section similar to the cross sections of the above-mentioned longitudinally-extending cavities 15. As shown in FIG. 5, the elastic member 16 is press-fit between the ring gear 10 and the front frame 9 with the annular base 17 surrounding the ring gear 10 near the open end, with the projections 19 extending into the corresponding cavities 15, and with the ledge 18 abutting against the end surface at the open end of the second cylindrical portion 10*b* of the ring gear 10.

The annular base 17 and the ledge 18 of the elastic member 16 serve as reinforcing members for the open end of the second cylindrical portion 10*b* of the ring gear 10 so as to prevent its deformation during operation. On the other hand, the projections 19 of the elastic member 16 serve as shock absorbing members for elastically transmitting loads from the ring gear 10 to the front frame 9. The reinforcing members and the shock absorbing members are preferably formed as a single molded body, since this decreases the number of parts and makes assembly easier, but this is not necessary, and they may be separate members and still provide the same effects.

Figure 6:
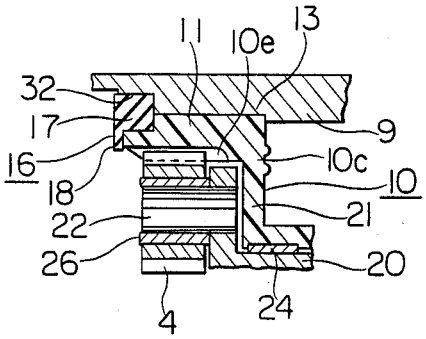

As shown in FIGS. 6 and 7, the length of the ribs 11 and the projections 12 is less than the length of the second cylindrical portion 10*b* in the axial direction of the ring gear 10 so that an unribbed portion is formed on the outer surface of the second cylindrical portion 10*b* near its open end, and an annular cavity 32 is formed between the outer surface of the second cylindrical portion 10*b* and the inner peripheral surface of the front frame 9 to the left of the projections 12 and the ribs 11 in FIGS. 6 and 7, respectively. The base 17 of the elastic member 16 is press fit into this cavity 32 and its inner peripheral surface tightly presses against the outer peripheral surface of the end of the second cylindrical portion 10*b*, thereby elastically reinforcing it.

As shown in FIG. 5, the sun gear 3 is integrally formed on the outer surface of a first output shaft 27 which is secured to the rotor of the direct current starter motor 40. The rotation of the first output shaft 27 is transmitted to a second output shaft 20 which is rotatably supported by a sleeve-shaped bearing 24 which is secured to the inner surface of the first cylindrical portion 10*a* of the ring gear 10. The second output shaft 20 has a radially-extending flange 21 formed thereon which has mounted thereon a number of support pins 22, each of which supports one of the planet gears 4 through a sleeve-shaped bearing 26 which fits over ths support pin 22. The second output shaft 20 has a cylindrical cavity 29 into which the end of the first ouput shaft 27 extends. The end of the first output shaft 27 is rotatably supported by a sleeve-shaped bearing 30 which is mounted on the inner surface of the cavity 29. A steel ball 31 is disposed inside the cavity 29 between the ends of the first and second ouput shafts for transmitting thrust loads.

The second output shaft 20 also has a helical spline 25 formed on its outer surface. As is conventional with this type of apparatus, an unillustrated overrunning clutch is slidably mounted on the helical spline 25 so as to move in the axial direction of the second output shaft 20. The overrunning clutch has a pinion gear formed thereon which can engage with a starter ring of an engine when the overrunning clutch is moved along the second output shaft 20 to the right in FIG. 5.

Figure 1:
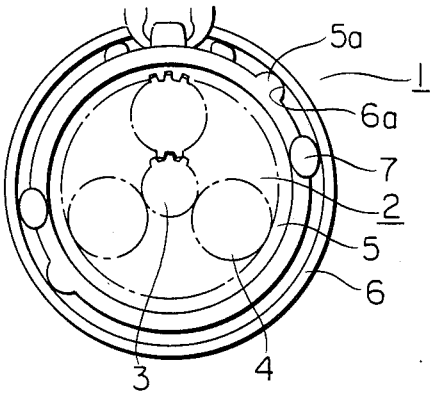
FIG. 1 PRIOR ART
FIG. 1 is an end view of a conventional starter having a planetary gear reduction mechanism housed therein.

The operation of the illustrated embodiment is basically the same as the conventional apparatus illustrated in FIG. 1. Namely, when an engine is to be started, the direct current starter motor 40 rotates the first output shaft 27, and this rotation is transmitted to the second ouput shaft 20 at a reduced speed by the planet gears 4 which revolve around the center of the first output shaft 27 while meshing with the sun gear 3 formed on the end of the first output shaft 27 and with the internal teeth 10*e* of the ring gear 10. The rotation of the second output shaft 20 is transmitted by the helical spline 25 to the unillustrated overrunning clutch, and the rotation of the pinion of the overrunning clutch is transmitted to the starter ring of the engine, thereby cranking the engine.

The rotational force applied to the ring gear 10 by the revolution of the planet gears 4 is transmitted by the elastic member 16 to the front frame 9, which reacts this force. When there is a sudden increase in the rotational force applied to the ring gear 10, such as when the engine dies during cranking, the projections 19 of the elastic member 16 act as shock absorbers to elastically transmit the force to the front frame 9, and the stresses produced in the ring gear 10 are reduced, preventing damage to the ring gear 10. The annular base 17 and ledge 18 of the elastic member 16, by tightly binding the end portion of the second cylindrical portion 10*b*, act to protect and reinforce the internal teeth 10*e* of the ring gear 10, which would otherwise be particularly subject to deformation and damage.

Figure 8:
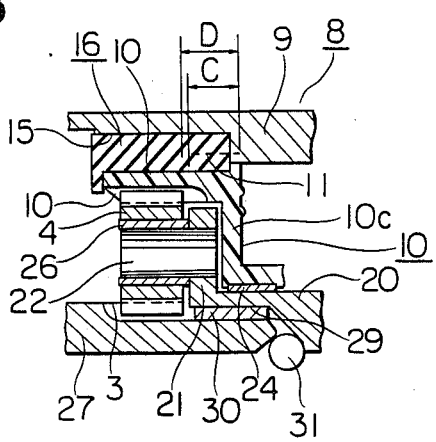
FIG. 8 is a longitudinal cross-sectional view of a second embodiment of a starter according to the present invention.

FIG. 8 is a cross-sectional view of a second embodiment of the present invention. The structure of this second embodiment is nearly identical to that of the first embodiment except that the length C in the longitudinal direction of the ring gear 10 of the ribs 11 formed on the ring gear 10 and the porjections 13 of the front frame 9 which confront the ribs 11 is less than the distance D from the right side of the wall 10*c* of the ring gear 10 to the point where the right ends of the planet gears 4 mesh with the internal teeth 10*e* of the ring gear 10. Choosing the dimensions in this manner contributes to the prevention of deformation of the internal teeth 10*e* of the ring gear 10 due to sink marks formed in the ribs 11 during molding.

The present inventors performed a number of experiments to determine the optimal hardness of the elastic member 16. When no elastic member 16 was used, the ring gear 10 had a breaking strength of 19 kg. When an elastic member 16 made of rubber having a Shore hardness of 50 was used, the breaking strength of the ring gear 10 was increased to 22 kg and the deformation of the ring gear 10 was 0.5 mm after 10,000 times durability test, and with a Shore hardness of 60, it had a breaking strength of 23 kg and 0.4 mm deformation . However, when the elastic member 16 had a shore hardness of 70, the breaking strength was markedly increased to 28 kg with 0.2 mm deformation, a Shore hardness of 80 resulted in the gear having a breaking strength of 30 kg and 0.2 mm deformation, and a Shore hardness of 90 resulted in the gear having a breaking strength of 32 kg with 0.1 mm deformation. Thus, in the present invention, the elastic member 16 preferably has a Shore hardness of at least 70. Although in the present embodiments rubber was used for the elastic member 16, there are no particular liminations on the material of which it is formed. Any elastic material having a suitable hardness and elasticity can be used.

What is claimed is:

1. A planetary gear starter comprising:

a direct current motor;

a first output shaft connected to the rotor of said motor so as to be driven thereby;

a planetary type reduction gear comprising a sun gear secured to said first output shaft so as to rotate therewith, a planet gear which meshes with said sun gear, and an internally-toothed ring gear which is concentrically disposed with respect to said sun gear and which internally meshes with said planet gear, said ring gear having a first cylindrical portion of a predetermined longitudinal length an open end and a plurality of longitudinally-extending ribs formed on an outer surface of said first cylindrical portion, said ribs extending for a distance less than the longitudinal length of said first cylindrical portion of said ring gear so as to provide an unribbed portion about said open end;

a second ouput shaft rotatably connected to said planet gear said second output shaft is rotated by the planetary movement of said planet gear about said sun gear;

a hollow frame having a cylindrical inner surface which receives said ring gear, said frame having a plurality of longitudinally-extending inward projections formed on the inner surface of said frame, said inward projections being disposed about the inner surface so that each of said inward projections engages a corresponding one of said ribs, a plurality of longitudinally extending cavities formed between the outer surface of the first cylindrical portion of said ring gear and the inner surface of said frame and respectively between the plurality of engaging ribs and inward projections;

an annular elastic reinforcing member secured in a press fit over the first cylindrical portion of said ring gear in said unribbed portion; and a plurality of longitudinally-extending elastic shock absorbing members respectively received in said cavities, each of said shock absorbing members having a shape and size which is substantially equal to and associated with one of said cavities formed between said frame and said ring gear.

2. A planetary gear starter as claimed in claim 1 wherein said elastic reinforcing member and said shock absorbing members are integrally formed as a single elastic member.

3. A planetary gear starter as claimed in claim 2 wherein said single elastic member is formed of a material having a hardness of at least 70 on the Shore hardness scale.

4. A planetary gear starter as claimed in claim 1 wherein said ring gear is made of a molded synthetic resin, and the width of each of said ribs measured in the circumferential direction of said ring gear is less than the thickness of said ring gear measured from the outer peripheral surface of said unribbed portion to the root circle of the internal teeth of said ring gear.

5. A planetary gear starter as claimed in claim 1 wherein said unribbed portion of said ring gear extends over the portion in which said planet gear meshes with the internal teeth of said ring gear.

6. A planetary gear starter as claimed in claim 1 wherein said ring gear further comprises a longitudinally-extending, rotation-preventing outward projection and said front frame has a corresponding recess formed in its inner surface in which said rotation-preventing projection is disposed, said rotation-preventing projection having a cavity formed therein.

7. A planetary gear starter as claimed in claim 1 wherein said ring gear further comprises a second cylindrical portion which has a smaller diameter than said first cylindrical portion and which rotatably supports said second output shaft, and an annular wall formed between one end of said second cylindrical portion and the end of said first cylindrical portion opposite from said open end, said first and second cylindrical portions and said annular wall being a single molded body.

* * * * *